United States Patent [19]

Toth

[11] Patent Number: 4,519,324

[45] Date of Patent: May 28, 1985

[54] GAS INJECTION METHOD FOR IMPROVING THE OPERATION OF A FLUIDIZED BED REACTOR

[75] Inventor: Dennis A. Toth, Lake Hopatcong, N.J.

[73] Assignee: Foster Wheeler Energy Corporation, Livingston, N.J.

[21] Appl. No.: 643,525

[22] Filed: Aug. 23, 1984

[51] Int. Cl.[3] ..... F23D 1/00

[52] U.S. Cl. ..... 110/347; 110/342; 110/343; 110/344; 110/263

[58] Field of Search ..... 110/263, 347, 342, 343, 110/344, 345, 245; 431/7, 170

[56] References Cited

U.S. PATENT DOCUMENTS

| | | | |
|---|---|---|---|
| 3,540,388 | 11/1970 | Smith et al. . | |
| 3,888,193 | 6/1975 | Kishigami et al. . | |
| 3,966,431 | 6/1976 | Craig et al. . | |
| 4,066,738 | 1/1978 | Daman . | |
| 4,102,277 | 7/1978 | Wall . | |
| 4,177,158 | 12/1979 | Blue . | |
| 4,191,115 | 3/1980 | Yang et al. . | |
| 4,226,601 | 10/1980 | Smith . | |
| 4,232,615 | 11/1980 | Brown . | |
| 4,249,472 | 2/1981 | Mitchell . | |
| 4,255,162 | 3/1981 | Moss . | |
| 4,262,610 | 4/1981 | Hein et al. | 110/342 |
| 4,303,023 | 12/1981 | Perkins et al. . | |
| 4,309,393 | 1/1982 | Nguyen . | |
| 4,359,005 | 11/1982 | Baston | 110/343 X |
| 4,387,653 | 6/1983 | Voss | 110/342 |

*Primary Examiner*—Edward G. Favors

*Attorney, Agent, or Firm*—Marvin A. Naigur; John E. Wilson; Warren B. Kice

[57] ABSTRACT

A method of operating a fluidized bed in which a bed of particulate combustible material and adsorbent material are disposed on a perforated plate. Air is introduced through said plate and into said bed to fluidize and promote the combustion of the combustible material, and a gaseous agent is injected into the bed to stabilize the surface hardness, sulfur-absorption properties and catalytic properties of said adsorbent material.

3 Claims, 1 Drawing Figure

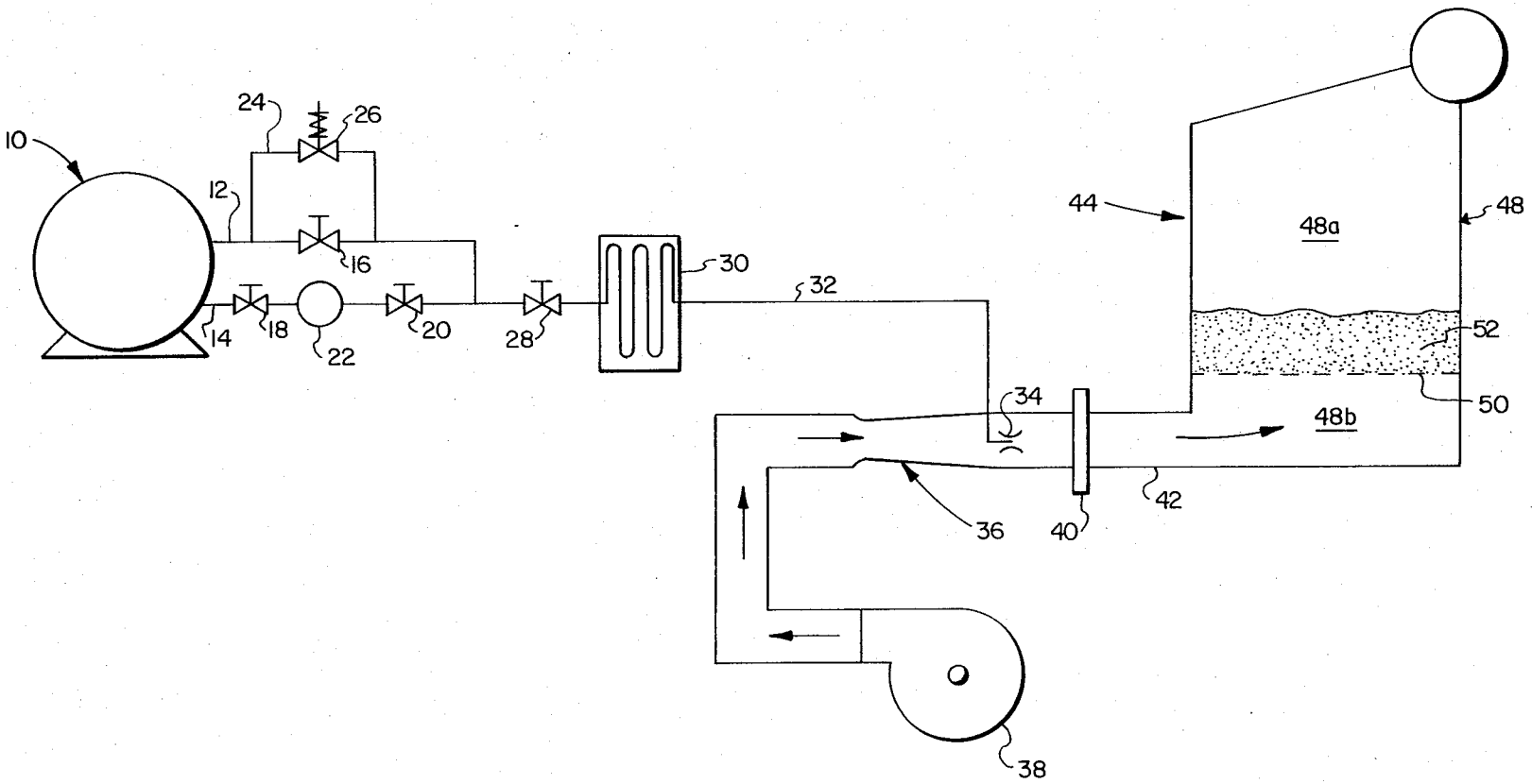
10
12
14
16
18
20
22
24
26
28
30
32
34
36
38
40
42
44
48
48a
48b
50
52

GAS INJECTION METHOD FOR IMPROVING THE OPERATION OF A FLUIDIZED BED REACTOR

BACKGROUND OF THE INVENTION

This invention relates to a method of operating a reactor and, more particularly, to a method for improving the reaction efficiency of a fluidized bed reactor.

The use of fluidized bed reactors, in the form of combustors, gasifiers or steam generators has been recognized as an attractive means of generating heat. In the operation of these reactors air is passed through a bed of particulate material which includes a mixture of inert material, a fuel material such as high sulfur, bituminous coal and, usually, an adsorbent material, such as limestone, for the sulfur formed as a result of the combustion of the coal. As a result of the air passing through the bed the bed is fluidized which promotes the combustion of the fuel. The basic advantages of such an arrangement are many and include a relatively high heat transfer rate, a substantially uniform bed temperature, combustion at relatively low temperatures, ease of handling the fuel materials, a reduction in corrosion and boiler fouling and a reduction in boiler size.

However, in these type of methods, the limestone is in a less than optimum condition with respect to surface hardness, sulfur adsorption properties and catalytic properties.

For example, during initial operation of the bed and especially when the coal being utilized has a low sulfur content, the limestone remains soft and tends to degrade before it has a chance to react with the sulfur and form an outer, relatively hard shell. This increases the amount of limestone needed to be fed to the system to maintain the required bed depth. This premature degradation also decreases the adsorption and catalytic properties of the limestone.

SUMMARY OF THE INVENTION

It is therefore an object of the present invention to provide a method of operating a fluidized bed reactor which enjoys all of the advantages of a fluidized bed yet permit a bed material of improved characteristics to be used.

It is a further object of the present invention to provide a method of the above type in which the soft calcium oxide utilized in the adsorbent material is stabilized to reduce its tendencies to degrade.

It is a still further object of the present invention to provide a method of the above type in which the bed material is preconditioned to improve its surface hardness, sulfur adsorption properties and catalytic properties.

Toward the fulfillment of these and other objects the method of the present invention includes the steps of passing air through a bed of particulate material which includes a fuel material and an adsorbent material to fluidize the bed and promote combustion of the fuel. A conditioning agent containing sulfur is injected into the fluidized bed to stabilize the surface hardness, the sulfur adsorption properties and the catalytic properties of the bed material and reduce the quantity of adsorbent material needed to be fed to the system.

BRIEF DESCRIPTION OF THE DRAWING

The above brief description, as well as further objects, features and advantages of the present invention will be more fully appreciated by reference to the following description of the presently preferred but nonetheless illustrative embodiment in accordance with the present invention, when taken in connection with the accompanying drawing which is a schematic representation highlighting the gas injection method of the present invention.

DESCRIPTION OF THE PREFERRED EMBODIMENT

Referring specifically to the drawing, a storage unit is shown in general by the reference numeral 10 which is adapted to receive and store a conditioning agent which contains sulfur dioxide or hydrogen sulfide. A pair of flow conduits 12 and 14 extend from the storage unit 10 in a parallel relationship. A valve 16 is connected in the conduit 12, and two valves 18 and 20 are connected in the conduit 14 and extend to either side of a pump 22. The valves 18 and 20 function as isolation valves 18 and 20 and are normally open.

A conduit 24 is connected in parallel with the conduit 12 and contains a pressure relief valve 26. A control valve 28 is provided in the conduit 14 and connects the storage unit 10 directly to a vaporizer 30. The vaporizer 30 operates in a conventional manner to vaporize any condensate that may enter via the flow conduit 14.

Under normal circumstances, valves 16 and 26 are closed and the valve 28 is opened so that gaseous agents from the storage unit 10 flow directly through the conduit 14 under the force of the pump 22 and into the vaporizer 30. In the event it is desired to recirculate the agent back into the unit 10, the control valve 28 is closed and the valve 16 is opened. In the event the pressure of the system exceeds a predetermined value, the valve 26 will come into play and automatically open to permit discharge of the gaseous agents into atmosphere.

The output from the vaporizer 30 is connected, via a flow conduit 32, to a diffuser nozzle 34 which injects the gaseous agent into an air conduit system 36. A forced draft fan 38 pressurizes ambient air and discharges it into the conduit system 36 for mixing with the gaseous agent from the diffuser nozzle 34.

The air conduit system 36 is connected, via a damper 40, to the inlet conduit 42 of a fluidized bed reactor shown in general by the reference numeral 44.

The reactor 44 comprises a housing 48 having a grate, or perforated plate, 50 extending across a lower portion thereof for dividing the housing into an upper chamber **48*a* and a lower chamber 48*b*. The conduit 42 registers with the lower chamber 48*b* of the reactor 44 so that the mixture of gaseous agent and pressurized air enters the lower chamber and passes upwardly through the grate 50 into the upper chamber 48*a***.

A bed 52 of particulate material is disposed on the grate 50 and includes a particulate fuel material, such as coal, and an adsorbent material, such as limestone, for the sulfur formed as a result of the combustion of the coal. The mixture of gaseous agent and air from the lower chamber **48*b* passes through the bed 52 and fluidizes same, with the excess air and the gaseous products of combustion passing upwardly through the chamber 48*a*** before exiting through an appropriate outlet (not shown).

It is understood that additional particulate fuel material and adsorbent material is discharged into the housing 48 in a conventional manner to replenish the reacted particulate material which is discharged from the reactor 44 through a drain system (not shown).

The reactor 44 can be in the form of a natural circulation system which would include a plurality of water-wall tubes forming the walls of the housing 48 through which water is circulated so that the heat generated by the fluidized bed converts the water to steam. This type of reactor is shown in general in U.S. Pat. No. 4,184,455, assigned to the assignee of the present invention, and since it, per se, does not form a portion of the present invention it will not be described in any further detail.

In the initial operation of the reactor 44 the raw limestone in the bed 52 is calcined by the heat resulting from the combustion of the coal in the bed. However, if the sulfur content of the coal is relatively low, the limestone remains in a calcined state and very little adsorption of the sulfur released as a result of the combustion of the coal is achieved. Since the calcined limestone is rather soft it tends to degrade or break up and is carried away by the fluidized air before any reaction takes place, which in addition to reducing the sulfur adsorption, severely reduces the integrity of the bed and compromises its performance.

This problem is eliminated by the present arrangement by introducing the $SO_2$ from the storage unit 10 into the bed 52 in the manner discussed above. The $SO_2$ initially converts the calcined limestone (CaO) to $CaSO_4$ which causes the surface of the limestone particles to harden, and thus increases their resistance to degradation. Thus the integrity of the bed is maintained along with the sulfur adsorption and catalytic properties of the limestone.

As soon as the bed and the sulfur adsorption is stabilized, the flow from the storage unit 10 into the bed is stopped and the bed functions in a normal manner.

It is understood that variations may be made in the foregoing without departing from the scope of the invention. For example, other compounds containing sulfur, such as $H_2S$, can be provided in the unit 10 and injected into the fluidized bed 52. Also, flow meters can be provided for adjusting the compound injected, and the fluidizing air/gas stream can be injected above the grate 50 rather than below same as shown in the drawing. It is also understood that a proper monitoring system is provided to analyze and monitor the amount of agent passing through the bed material to allow control of the conditioning process.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A method of operating a fluidized bed comprising the steps of forming a bed of relatively soft adsorbent material for adsorbing sulfur produced as a result of the combustion of a combustible material, introducing air into said bed to fluidize said soft material, injecting a gaseous agent into said bed to increase the surface hardness of said adsorbent material and prevent the latter from degrading and being carried away from said bed by said air, and introducing a particulate combustible material to said bed.

2. The method of claim 1 wherein said adsorbent material is limestone and wherein said gaseous agent is hydrogen sulfide or sulfur dioxide which reacts with the limestone to form calcium sulfate.

3. The method of claim 1 further comprising the step of calcining said limestone by the heat of said bed.

* * * * *